US007201238B2

(12) United States Patent
Marvin et al.

(10) Patent No.: US 7,201,238 B2
(45) Date of Patent: Apr. 10, 2007

(54) LOW FRICTION FACE SEALED REACTION TURBINE ROTORS

(75) Inventors: Mark H. Marvin, Tacoma, WA (US); Jack J. Kollé, Seattle, WA (US)

(73) Assignee: Tempress Technologies, Inc., Kent, WA (US)

( * ) Notice: Subject to any disclaimer, the term of this patent is extended or adjusted under 35 U.S.C. 154(b) by 146 days.

(21) Appl. No.: 10/990,757

(22) Filed: Nov. 17, 2004

(65) Prior Publication Data

US 2005/0109541 A1 May 26, 2005

Related U.S. Application Data

(60) Provisional application No. 60/520,919, filed on Nov. 17, 2003.

(51) Int. Cl.
*E21B 7/18* (2006.01)

(52) U.S. Cl. ..... 175/67; 175/107; 175/424; 166/223

(58) Field of Classification Search ..... None
See application file for complete search history.

(56) References Cited

U.S. PATENT DOCUMENTS

| | | | | |
|---|---|---|---|---|
| 2,963,099 | A | 12/1960 | Gianelloni, Jr. | 175/25 |
| 3,054,595 | A | 9/1962 | Kaufmann | 415/107 |
| 3,058,510 | A | 10/1962 | Tiraspolsky et al. | 415/107 |
| 3,433,489 | A | 3/1969 | Wiese | 277/74 |
| 3,802,515 | A | 4/1974 | Flamand et al. | 173/176 |
| 3,810,637 | A | 5/1974 | Bonvin | 277/96 |
| 4,114,703 | A | 9/1978 | Matson, Jr. et al. | 175/107 |
| 4,196,911 | A | 4/1980 | Matsushita | 277/74 |
| 4,225,000 | A | 9/1980 | Maurer | 175/107 |
| 4,246,976 | A | 1/1981 | McDonald, Jr. | 175/107 |
| 4,324,299 | A | 4/1982 | Nagel | 175/107 |

(Continued)

FOREIGN PATENT DOCUMENTS

DE 1568680 6/1980

(Continued)

OTHER PUBLICATIONS

Kollé, Jack K., "Moving an Ice Mountain." Mechanical Engineering, Feb. 1990, pp. 49-53.

(Continued)

*Primary Examiner*—Zakiya W. Bates
(74) *Attorney, Agent, or Firm*—Ronald M. Anderson

(57) ABSTRACT

Rotary jetting tool including a rotor with axially-opposed pressure-balanced mechanical face seals. Vented upper mechanical face seal enables the rotor to be operated with the relativity low starting torque achievable using reaction forces from offset jets energized with a pressurized fluid. When rotor is displaced axially due to set-down conditions, a pressure chamber exerts a pressure imbalance on the rotor, forcing the rotor to return to a normal operating position. Alternate structure to achieve low starting torque includes a volume disposed adjacent to a lower mechanical face seal, the volume being coupled in fluid communication with the pressurized fluid. Mechanical face seal surfaces are fabricated from ultra-hard materials, such as tungsten carbide, silicon carbide, and diamond. A gage ring designed to ensure the jets remove all of the material from the gage of the protective housing before the tool can advance can be incorporated.

69 Claims, 9 Drawing Sheets

U.S. PATENT DOCUMENTS

| | | | | |
|---|---|---|---|---|
| 4,437,525 | A | 3/1984 | O'Hanlon et al. | 175/218 |
| 4,440,242 | A | 4/1984 | Schmidt et al. | 175/718 |
| 4,493,381 | A | 1/1985 | Kajikawa et al. | 175/107 |
| 4,521,167 | A * | 6/1985 | Cavalleri et al. | 418/82 |
| 4,529,046 | A | 7/1985 | Schmidt et al. | 175/107 |
| 4,665,997 | A | 5/1987 | Maurer et al. | 175/107 |
| 4,715,538 | A | 12/1987 | Lingnau | 239/248 |
| 4,747,544 | A | 5/1988 | Kräanzle | 239/251 |
| 4,821,961 | A | 4/1989 | Shook | 239/253 |
| 4,905,775 | A | 3/1990 | Warren et al. | 175/45 |
| 4,923,120 | A | 5/1990 | Hammelmann | 239/252 |
| 4,934,254 | A | 6/1990 | Clark et al. | 277/96.2 |
| 5,028,004 | A | 7/1991 | Hammelmann | 239/120 |
| 5,603,385 | A | 2/1997 | Colebrook | 175/45 |
| 5,685,487 | A | 11/1997 | Ellis | 239/261 |
| 5,909,848 | A * | 6/1999 | Zink | 239/252 |
| 5,909,879 | A | 6/1999 | Simpson | 277/399 |
| 5,938,206 | A | 8/1999 | Klosterman et al. | 277/399 |
| 6,062,311 | A | 5/2000 | Johnson et al. | 166/312 |
| 6,263,969 | B1 | 7/2001 | Stoesz et al. | 166/334.4 |
| 6,347,675 | B1 * | 2/2002 | Kolle | 176/69 |
| 6,453,996 | B1 | 9/2002 | Carmichael et al. | 166/177.3 |
| 6,557,856 | B1 | 5/2003 | Azibert et al. | 277/401 |

FOREIGN PATENT DOCUMENTS

| | | |
|---|---|---|
| SU | 587240 | 6/1980 |

OTHER PUBLICATIONS

Kollé, Jack K., "A Comparison of Water Jet, Abrasive Jet and Rotary Diamond Drilling in Hard Rock." Presentation for Energy Sources Technology Conference & Exhibition (ETCE '98), Houston, Texas: Feb. 2-4, 1998, 6pp.

* cited by examiner

LOW FRICTION FACE SEALED REACTION TURBINE ROTORS

RELATED APPLICATIONS

This application is based on a prior now abandoned provisional application Ser. No. 60/520,919, filed on Nov. 17, 2003, the benefit of the filing date of which is hereby claimed under 35 U.S.C. § 119(e).

FIELD OF THE INVENTION

This invention generally relates to rotary jetting tools for drilling and servicing oil and gas wells and production equipment, and more specifically, to a reaction turbine rotor with axially-opposed pressure-balanced mechanical face seals.

BACKGROUND OF THE INVENTION

There are a wide variety of applications where process or transport tubing becomes fouled with deposits or scale. Water jets, generated by a rotating jetting tool and directed across the internal surface of the tubing or pipe, are commonly used for cleaning these deposits. Such rotating jetting tools can also be used to drill through soil and rock formations. The jet quality provided by the rotating jetting tool is important, especially in harder formations. Jet quality is affected by a number of factors, including standoff distance and upstream flow conditions. Orienting the discharge nozzles of the tool at a large angle relative to its axis of rotation reduces jet standoff distance and improves jetting performance. Uniform upstream flow channels improve jet quality by reducing turbulence intensity. Many designs for rotating jetting tools incorporate relatively small fluid passages, which reduce the pressure and power available for jetting. Other systems require that the operating fluid used be filtered to a high degree, which adds significant expense and complexity. It would be desirable to provide a rotary jetting tool with relatively large flow passages, which does not require the use of an extensively filtered operating fluid.

Rotating jetting tools may use an external motor to provide rotation, or the rotor can be self-rotating. A self-rotating system greatly simplifies the tool operation. In a typical self-rotating system, the jets of liquid are discharged with a tangential component of motion, which provides the torque necessary to turn the rotor. Most self-rotating systems use a sliding seal and support bearing to enable the rotation of the working head. The drawback to this configuration is that the torque produced by the working jets must be sufficient to overcome the static bearing and seal friction. The dynamic friction of bearings and seals is typically lower than the static friction, so once the rotor has started to turn, it can spin at excessive speeds, which can cause overheating or bearing failure. It would be desirable to provide a rotary jetting tool that is configured to prevent such excessive rotation.

Most self-rotating jetting systems also incorporate a thrust bearing to counteract the internal pressure of the fluid against the nozzle. These bearings are subject to high loads and can fail when the rotor's rotational speed is excessive. The thrust load can be eliminated with a balanced or floating rotor design, wherein the shaft is supported by opposed radial clearance seals. If the shaft diameter is the same on both ends of the rotor, there is no thrust due to the internal pressure of the fluid. The clearance seals also act as hydrodynamic journal bearings, which rely upon a thin film of fluid that supports the rotating shaft using hydrodynamic forces. While journal bearings cannot support high thrust or radial loads, they are effective at high velocity—where the hydrodynamic support is greatest.

This approach has been used by Schmidt (as disclosed in U.S. Pat. No. 4,440,242) and Ellis (as disclosed in U.S. Pat. No. 5,685,487) to achieve a self-rotating jet. In the Ellis design, the working fluid is introduced from the tangential surface of the rotor shaft to the center of the rotor by crossing ports. One drawback to this configuration is that the fluid settling chamber is small compared with the sealing diameter of the rotor. In the Schmidt patent, the jet rotor extends well beyond the thrust-balanced section and can be relatively large.

The greatest drawback to the use of radial clearance seals is that clearance seals are prone to jamming with debris, especially when the operating pressure is applied slowly. Sealing, for this approach, is accomplished by maintaining a small clearance, or gap, between the inner and outer elements of the rotor, and leaving a small leakage path for the fluid. Particles approximately the same size or larger than the gap can easily get jammed in the gap and can build up during periods when fluid pressure is low and the rotor is not spinning. When the fluid pressure is increased, such particles are jammed even tighter into the gap and will then prevent the rotor from spinning freely. To avoid this problem, the working fluid must be filtered to remove all particles that might obstruct the smallest gap in the rotor head. Because the gaps must be small to prevent excessive fluid leakage, the fluid must again be filtered to a high degree. In many applications, a relatively large volume of working fluid is required, and filtering the fluid becomes impractical. It is also desirable to be able to pump abrasives or other particles through a jet rotor to enhance the jetting process.

Mechanical face seals overcome the problem of debris jamming the sealing gap. The nominal gap between the sealing surfaces is zero, and leakage is zero when the rotor is not rotating. If fluid is not flowing through the gap, debris cannot be carried into it. Secondly, the sealing gap is not rigidly fixed, as in a radial clearance seal. One element of a mechanical face seal is spring loaded and pressure activated with a secondary seal. If, for some reason, a particle were conveyed into the gap between the sealing faces, the sealing faces can spread, enabling the particle to pass through. Thus, particles are unlikely to become stuck in the sealing gap, and if they do, such particles can escape from the gap as a result of this self-clearing action.

The use of pressure-balanced mechanical face seals for fluid pumping applications is well known in the art. The most common application of mechanical face seals is to provide a fluid seal around a rotating shaft where the shaft penetrates a pressurized vessel so that the fluid is retained in the vessel and does not leak out of the vessel around the shaft. In most cases, such as in single-stage centrifugal pumps, the end of the shaft is exposed to an elevated pressure. This pressure, multiplied by the effective sealing area, produces an end load on the shaft to which a thrust bearing must react. In most pump applications, external support bearings can be provided to withstand the thrust. A mechanical face seal includes a rotating seal ring with a face that slides on a static seal ring. The rotating seal ring is keyed to rotate with the shaft, and is provided with a static seal element that can slide along the shaft. Pressure forces on the rotating element force it axially into contact with a static seal element that is attached to the pressurized vessel. As long as the contact force is greater than the pressure within the pressurized vessel, the seal is effective. The contact force between mechanical sealing faces is determined by the balance ratio of the seal. The balance ratio represents the ratio between the sealed area and the area on which the average pressure between the seal faces acts. This ratio can be adjusted by controlling the seal ring contact area and diameter of the static seal between the rotating seal ring and the shaft. Since the average pressure between the seal faces is normally about one-half the sealed pressure, the seal head will be in equilibrium for a balance ratio of 0.5. It is common practice to choose a balance ratio from 0.65 to 0.75 for contacting face seals. High pressure results in high contact forces between the seal faces, which can lead to premature failure and a high starting torque.

Conventional mechanical face seals have not been used in high-pressure rotating jetting tools for a variety of reasons. The high operating pressure imposes a high shaft end load, which is the product of the operating pressure and the area of the rotating shaft that is sealed. In a conventional design, the shaft load is supported by separate thrust bearings, and the pressure is sealed with a mechanical face seal. The need for separate thrust bearings complicates the tool design and increases the length of the jetting tool. Secondly, the high-operating pressure imposes high contact loads on the seal faces, which results in a high starting torque. The most convenient mechanism for imparting a rotational force to a rotating jetting tool is to use the reaction torque generated by offset jets. This torque is relatively small and is generally insufficient to overcome the friction torque of a conventional mechanical face seal. Finally, it may be desirable to operate rotating jetting tools at relatively high rotational speeds, resulting in a high pressure-velocity (PV) load on any conventional mechanical face seal included within the rotating jetting tool. The PV relationship is defined as the product of contact stress and sliding velocity. High PV values cause premature wear and failure of mechanical face seals. For rotors used in rotating jetting systems for drilling and servicing oil and gas wells and production equipment, an external thrust bearing is impractical, and the thrust loads must be much lower than those induced by the working pressure multiplied by the effective seal area. It would thus be desirable to provide a rotor designed for use in rotating jetting systems for the oil and gas industry that provides the benefits of mechanical face seals, but without the disadvantages of mechanical face seals that were discussed above.

SUMMARY OF THE INVENTION

The present invention is a reaction turbine rotor with axially-opposed pressure-balanced mechanical face seals. The rotor is capable of operating with low starting torque, consistent with the relatively low torque generated by the reaction forces of offset jets. The pressure-balanced design of the present invention limits the contact forces on the mechanical face seals, thereby reducing wear and torque. Also, the mechanical face seal surfaces are fabricated from ultra-hard materials, such as tungsten carbide, silicon carbide, and diamond, to minimize wear.

In the event that the rotor contacts the material being cut, the lower mechanical face seal opens and the jetting head is supported by the tool housing, preventing mechanical loading of the seal elements. Contact with the material being cut is accompanied by a predetermined pressure reduction, which can easily be detected on surface, to enable the operator to back the tool off the obstruction. When the tool is backed off, hydraulic features in the tool ensure that the forward face seal will again close and that the tool will restart.

BRIEF DESCRIPTION OF THE DRAWING FIGURES

The foregoing aspects and many of the attendant advantages of this invention will become more readily appreciated as the same becomes better understood by reference to the following detailed description, when taken in conjunction with the accompanying drawings, wherein.

Figure 9A:
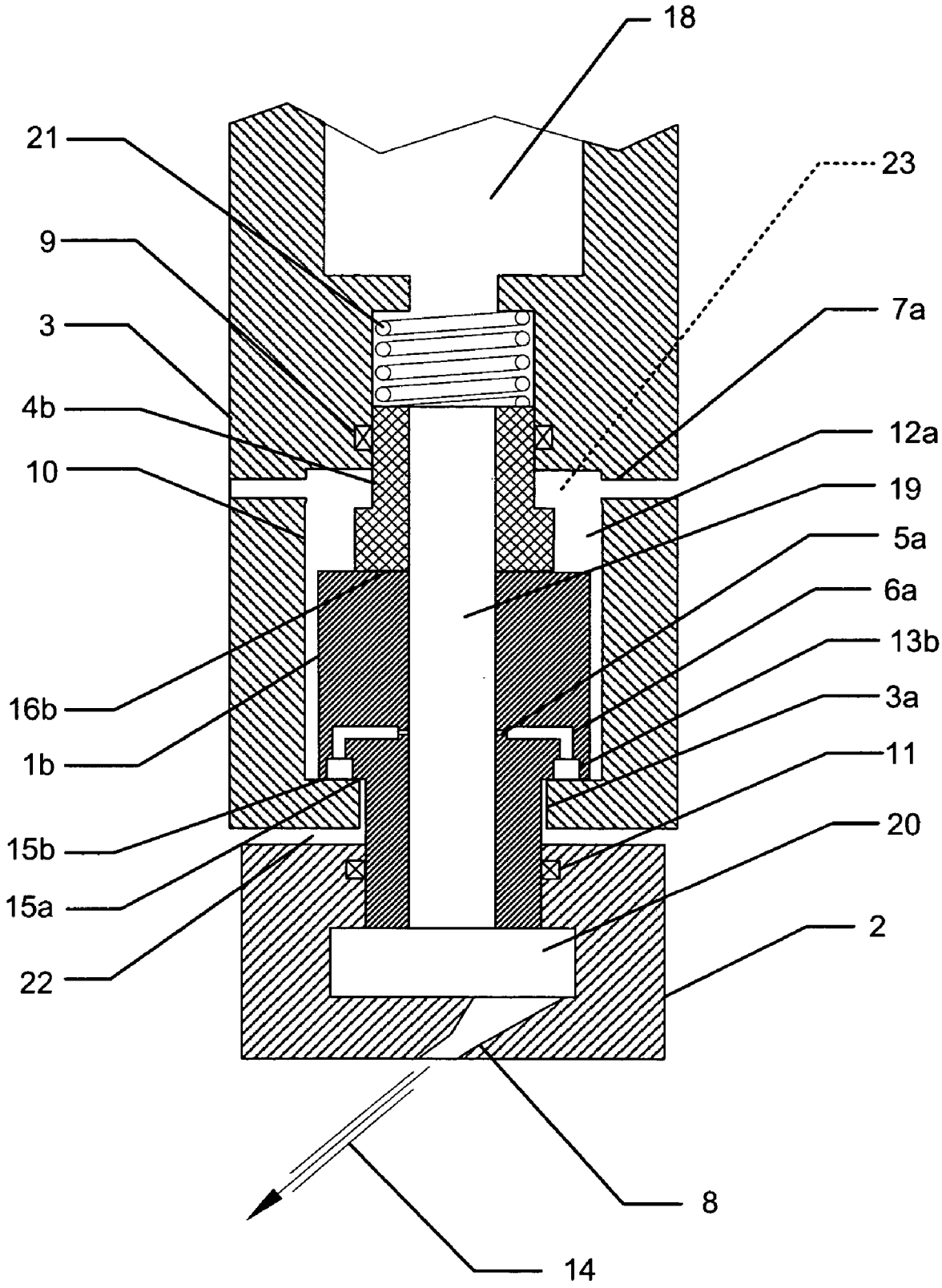
FIG. 9A is a cross-sectional side view of yet another embodiment of a rotary jetting tool in accord with the present invention, in which an annular recess is formed in a distal face of the rotor shaft, to achieve a pressure-balanced lower mechanical face seal.
Figure 9B:
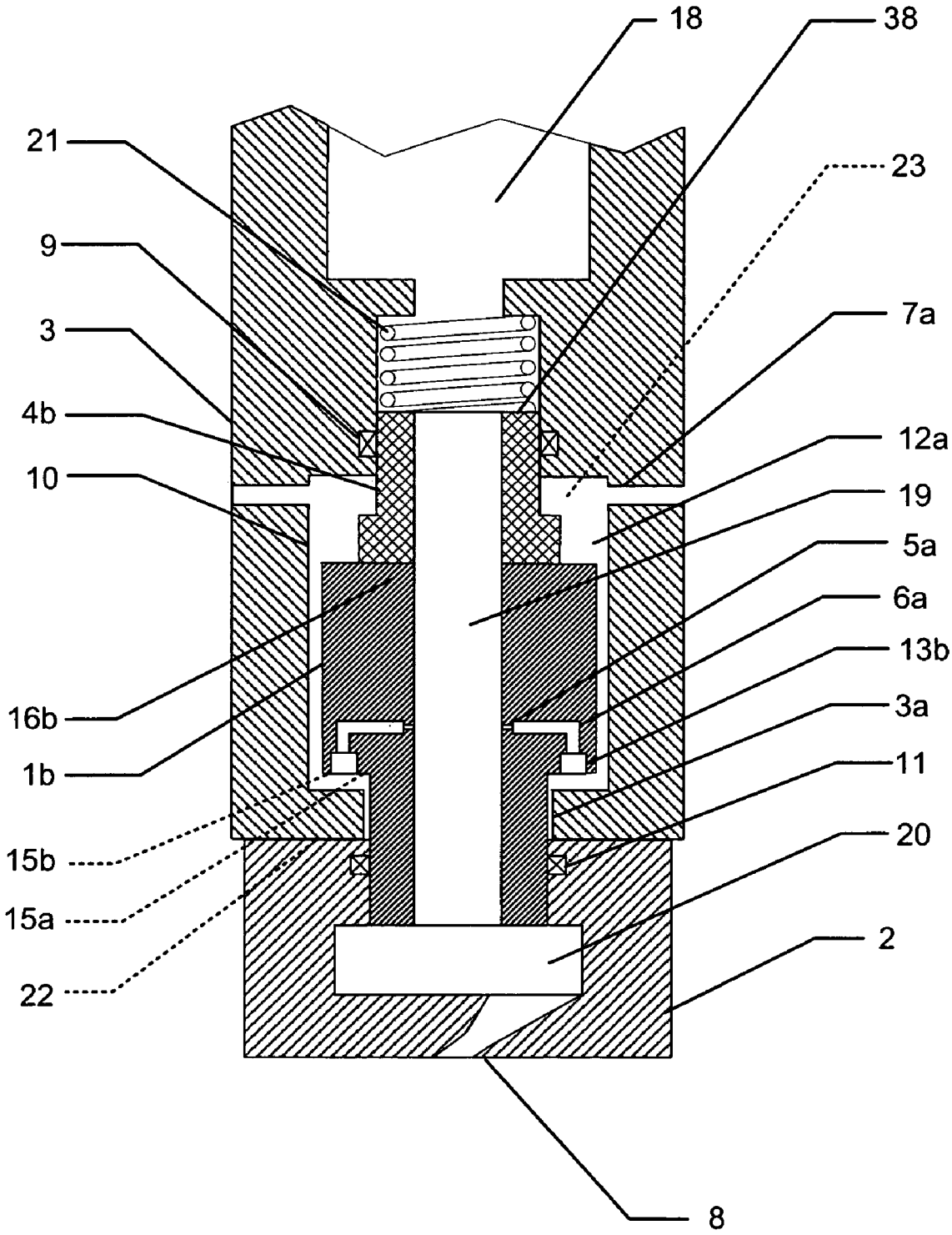
Figure 10:
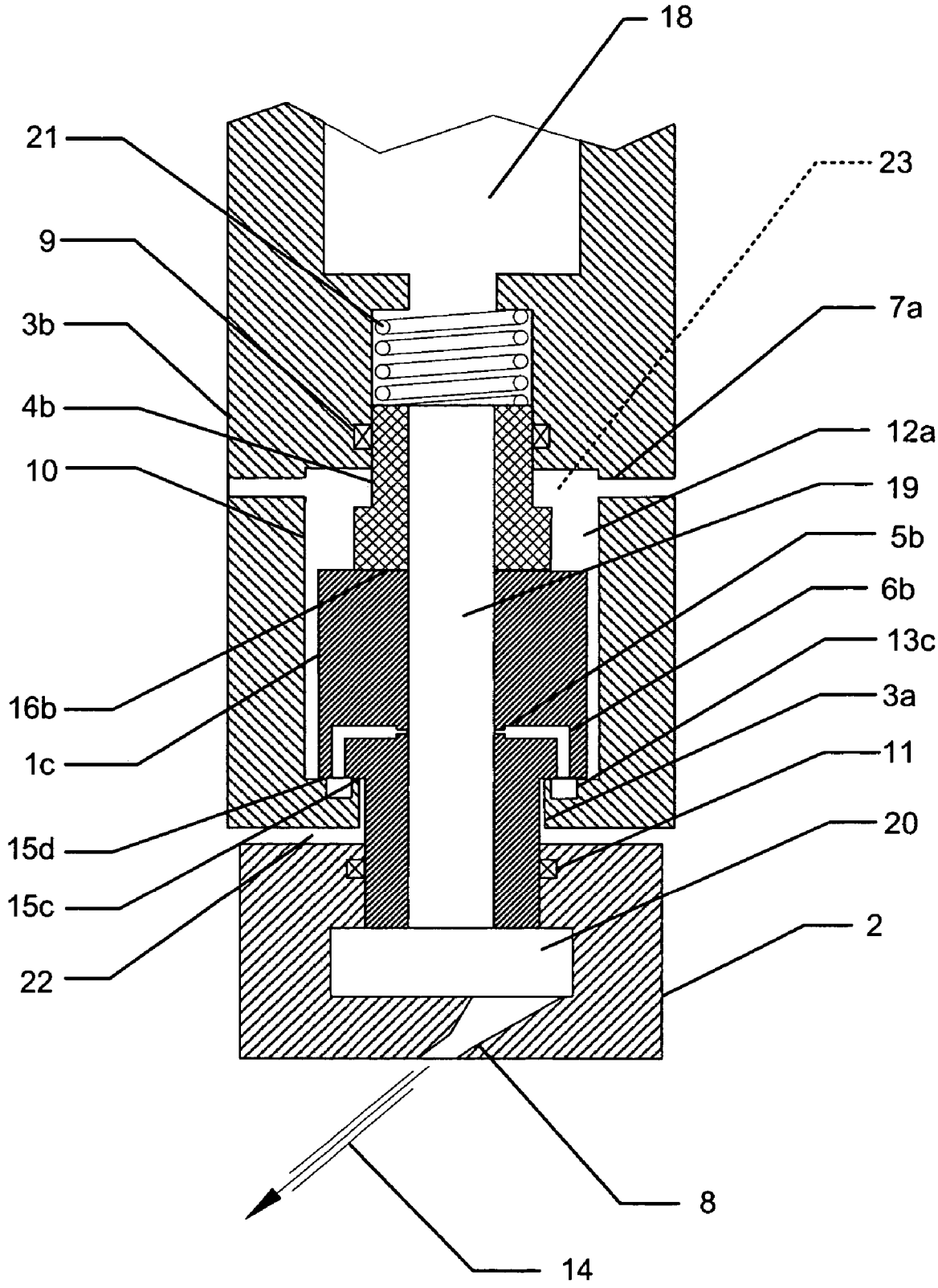

FIG. 9B is a cross-sectional side view showing the rotary jetting tool of FIG. 9A in a set-down condition; and FIG. 10 is a cross-sectional side view of still another embodiment of a rotary jetting tool in accord with the present invention, in which an annular recess utilized to achieve a pressure balanced lower mechanical face seal is formed in the housing adjacent to the distal face of the rotor shaft.

DESCRIPTION OF THE PREFERRED EMBODIMENT

Figure 1:
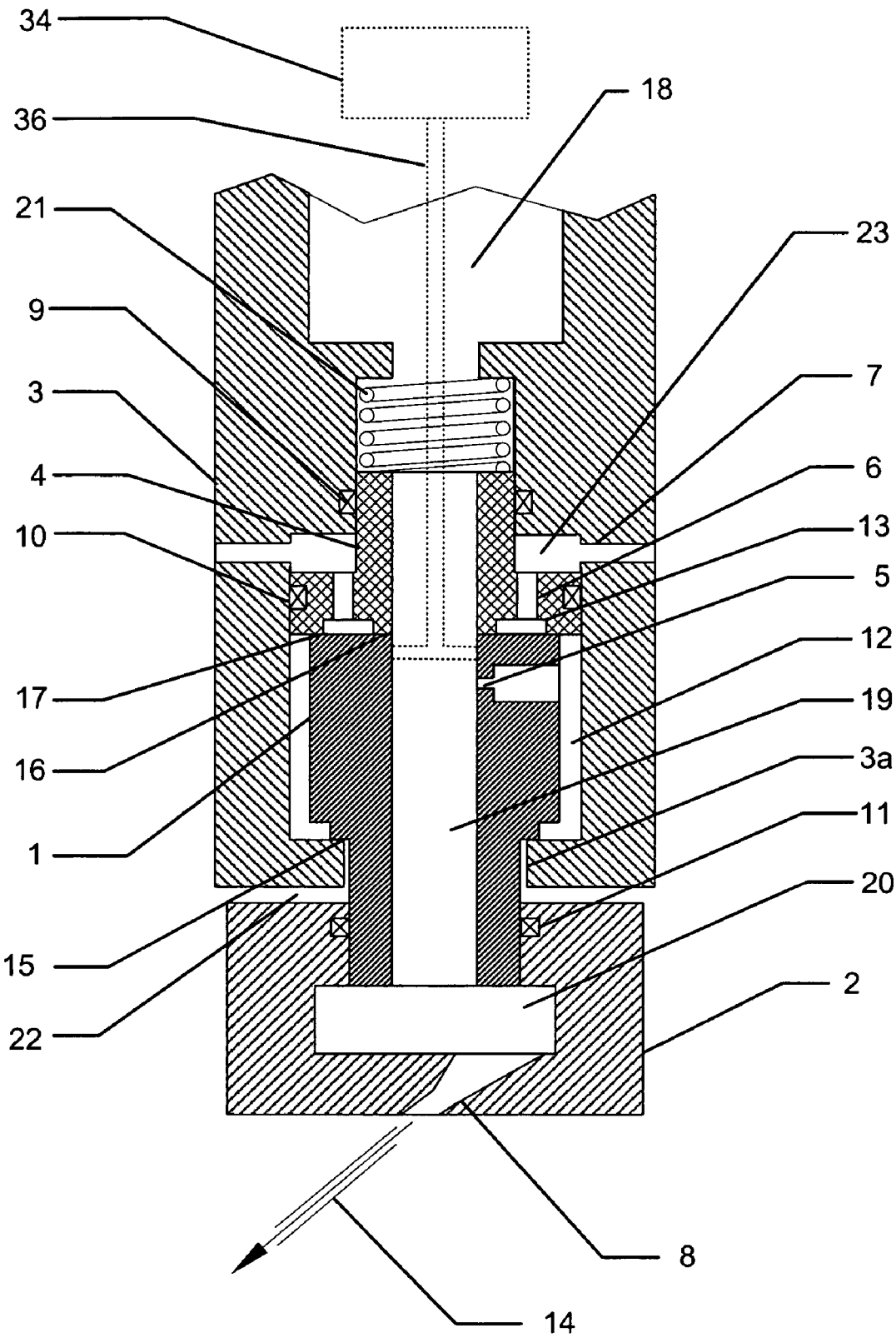
FIG. 1 is a cross-sectional side view that shows components of a rotary jetting tool in accord with the present invention, including a rotor and sealing elements.

Referring to FIG. 1, a cross-sectional side view of a rotary jetting assembly in accord with the present invention is shown. The assembly includes four major components, including a rotor shaft 1, a nozzle head 2, a housing 3, and a seal head 4. Rotor shaft 1 and seal head 4 are disposed in housing 3, which includes a pressure chamber 12 (capable of withstanding the operating pressure of the system). Fluid enters at the top of housing 3 through an inlet passage 18, and is conveyed to pressure chamber 12 through an orifice 5, and to a reservoir 20 in a nozzle head 2 through a flow-through passage 19. While the present invention can be operated using a wide range of fluid pressures, normal operating pressures will range from about 3000 PSI to about 15,000 PSI. However, it should be understand that this range is exemplary, and is not intended to limit the present invention, since operating pressures as low as 1000 PSI and as high as 40,000 PSI are clearly possible. Nozzle head 2 is affixed to the end of rotor shaft 1, and fluid is confined by a static seal 11. The fluid is accelerated through one or more nozzles 8, forming a fluid jet 14. The fluid jet(s) are positioned and oriented such that the reactive force of the jet(s) produces a torque directed about a center of rotation of the rotor shaft, causing rotor shaft 1 and nozzle head 2 to rotate. Alternatively, rotor shaft 1 can be coupled to an optional motor 34 by a driveshaft 36. In such an alternative embodiment, the nozzles need not be oriented to ensure rotation of the rotor shaft and nozzles. Optional motor 34 can be incorporated into a drill string or coiled tube assembly the rotary jetting assembly itself is incorporated into, motor 34 can be incorporated into the rotary jetting assembly, or motor 34 can be disposed at a remote location, such as at the surface of borehole, or the mouth of a tube.

There are three pairs of dynamic mechanical sealing faces in the rotary jetting assembly of FIG. 1, including a lower mechanical face seal 15, an upper inner mechanical face seal 16, and an upper outer mechanical face seal 17. Sealing is accomplished by a net contact force between the rotating face and stationary face of a seal pair. Because the torque produced by the fluid jets is relatively low, it is necessary to minimize the torque that is required to rotate the seals.

Preferably, ultra-hard materials are used for each sealing face. Such materials generally having relatively low coefficients of friction and provide superior wear resistance. Polycrystalline diamond surfaces are very resistant to wear, while also providing low frictional resistance to rotation, particularly after an initial period of use (during which the opposed polycrystalline diamond surfaces are subject to mutual smoothing). Other forms of ultra-hard materials may alternatively be employed, such as silicon carbide, cubic boron nitride, and amorphous diamond-like coating (ADLC). Preferably, for each pair of opposed sealing faces, each sealing face is implemented using a different ultra-hard material, which those skilled in the art will recognize provide reduced friction. The opposing faces of a gap between rotor shaft 1 and housing 3 (where the rotor shaft passes through the housing) may incorporate such ultra-hard materials, which act as a radial bushing to maintain alignment between the rotor and the housing.

Figure 3A:
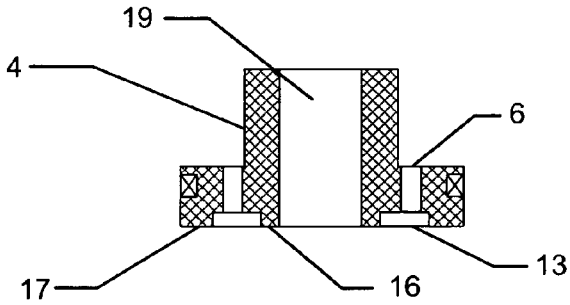
FIG. 3A is a cross-sectional side view of a seal head included in the rotary jetting tool of FIG. 1.
Figure 3B:
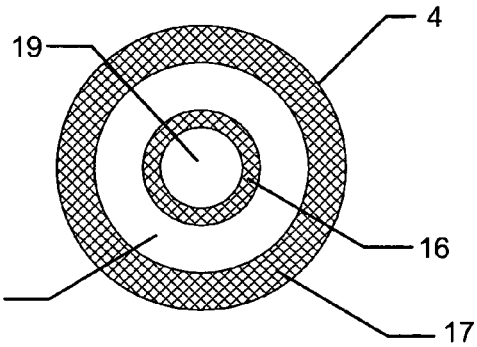
FIG. 3B is a bottom view of the seal head of FIG. 3A, showing the annular recess separating an upper mechanical face seal into an inner mechanical face seal and an outer mechanical face seal, the annular recess being coupled in fluid communication to a volume external of the rotary jetting tool.

The present invention reduces startup friction using a unique structure, a mid-face vented mechanical face seal. The mid-face vented mechanical face seal is implemented in seal head 4, which is shown in FIGS. 3A and 3B. A mid-face vent cavity 13 is ported to ambient pressure through the seal head venting passages 6 to a take-up chamber 23 and housing venting passages 7, which creates an annular region of low pressure on the top side of rotor shaft 1, reducing the net force acting on lower mechanical face seal 15. It will be recognized that mid-face vent cavity 13 may be incorporated in the upper face of rotor shaft 1 with no change in function. The mid-face vented seal comprises upper inner mechanical face seal 16, upper outer mechanical face seal 17, and mid-face vent cavity 13. Mid-face vent cavity 13 is isolated from inlet pressure by upper inner seal 16 and from pressure chamber 12 by upper outer mechanical face seal 17. The upper inner and outer seals are implemented by forming an annular recess (i.e., mid-face vent cavity 13) in what would otherwise be a flat face, and by adding venting holes (passages 6, passages 7, and take-up chamber 23) to port that region of the seal to a region of substantially lower pressure (i.e., ambient pressure). In one preferred embodiment, mid-face vent cavity 13 is formed in seal head 4, the seal head being able to move axially relative to housing 3. Take-up chamber 23 is isolated from the inlet pressure by a first secondary seal 9, and from pressure chamber 12 by a second secondary seal 10. These seals enable seal head 4 to move slightly (axially) to compensate for manufacturing tolerances and wear, to permit the escape of entrapped debris, and to compensate for external mechanical loading conditions that cause rotor shaft 1 to move in the axial direction. The effective sealing diameters of secondary seals 9 and 10 are sized such that the sum of the hydrostatic forces on seal head 4 causes it to be lightly loaded against the mating face of rotor shaft 1. This configuration provides the net contact force needed to activate upper inner mechanical face seal 16 and upper outer mechanical face seal 17. A spring 21 is disposed so as to force seal head 4 (and in turn, rotor shaft 1) forward, causing a light contact force on all of the sealing surfaces even when no fluid pressure is present. This contact force ensures that as pressure is applied, there is no leakage flow and therefore, that debris is not entrapped between the sealing surfaces. It should be noted however, that spring 21 is not strictly required, and it should also be understood that the force exerted by such a spring is relatively small compared to the fluid pressure exerted on the rotor shaft during normal operation. The fluid pressures exerted on the rotor shaft are not only much higher than the spring forces, the fluid pressure forces are opposed and balanced (regardless of the pressure of the operating fluid) to reduce the contact forces on the face seals. The force generated by the spring is constant, and is a readily overcome by the fluid pressure forces during normal operating conditions.

Housing 3 includes an orifice 3*a* disposed immediately distal of lower mechanical face seal 15. Orifice 3*a* is sized slightly larger than the portion of rotor shaft 1 that passes through orifice 3*a*, such that a small gap exists between the rotor shaft and the orifice. Because of imperfections in the sealing faces in mechanical face seals, some pressurized fluid will leak past lower mechanical face seal 15 into the gap between rotor shaft 1 and orifice 3*a* during normal operation. This fluid provides lubrication and a cooling effect on the opposing surfaces of the gap, which act as a radial bushing during normal operation, as noted above. As described in detail below, certain conditions can cause axial movement of rotor shaft 1, resulting in the opening of lower mechanical face seal 15. Under such conditions, more pressurized fluid will flow through orifice 3*a* than during the normal operating condition. In one preferred embodiment, the gap between orifice 3*a* and rotor shaft 1 ranges from about 0.003 inches to about 0.0015 inches. The gap provides a leak path for pressurized fluid.

Figure 2:
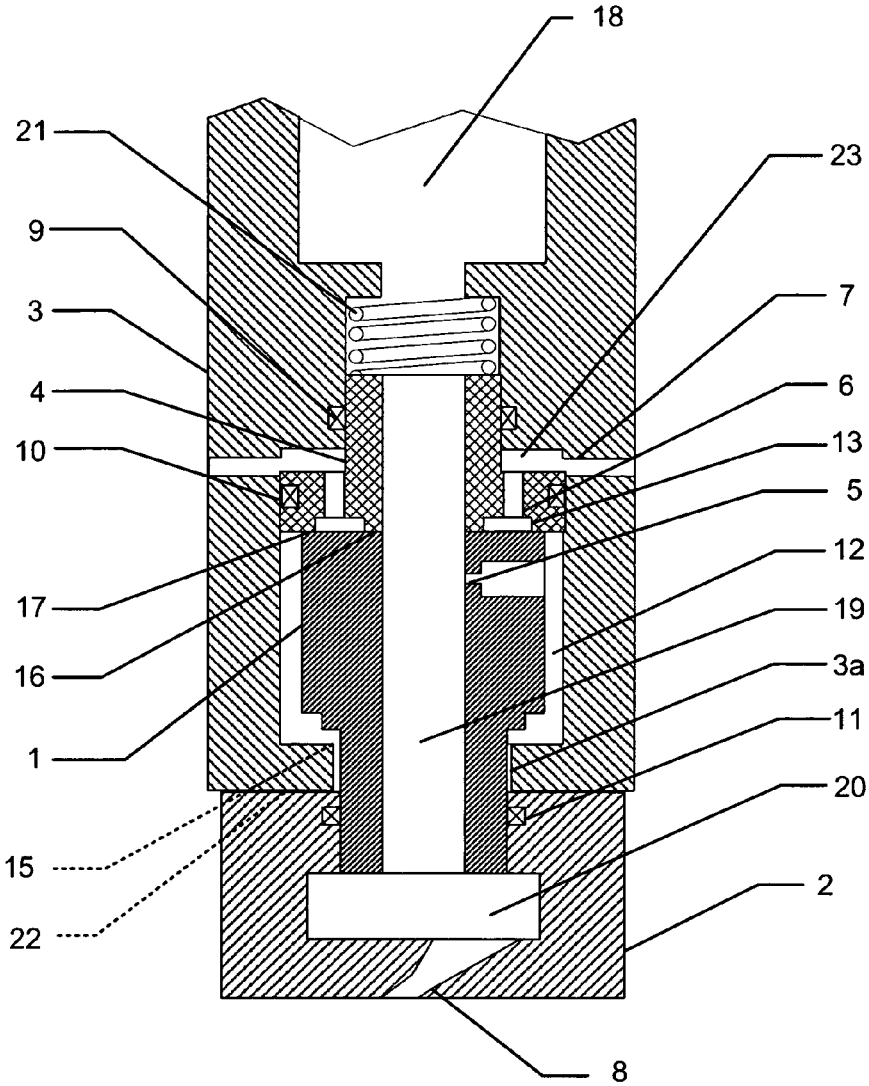
FIG. 2 is a cross-sectional side view of the rotary jetting tool of FIG. 1 in a set-down condition.

When nozzle head 2 contacts uncut material, or is "set-down," as illustrated in FIG. 2, an end load is generated that forces nozzle head 2, rotor shaft 1, and seal head 4 back into housing 3. A set-down gap 22 is provided, enabling these components to shift slightly. This gap is smaller than the gap in take-up chamber 23, so that contact is made between nozzle head 2 and housing 3. The end load is transmitted from nozzle head 2 to housing 3, not from nozzle head 2 to rotor shaft 1 and seal head 4, which protects the high-hardness mechanical face seal elements from mechanical loading. When nozzle head 2 is set-down, a gap is opened in lower mechanical face seal 15, and fluid leaks from pressure chamber 12 at a much higher rate than during normal operation, as noted above. Note that in FIG. 2, gap 22 is indicated with a dashed tag line, because the gap is closed. The tag line for lower mechanical face seal 15 is similarly indicated as a dashed line, because in the set down condition the lower mechanical face seal is open (i.e. the rotor is not sealingly engaging the housing). This condition decreases the effective sealing diameter of lower seal 15 and can cause the rotor shaft to stick in a position with the gap open. In prior art tools of similar design, under these conditions, the rotor will not resume rotation when the external load is removed. If the force provided by spring 21 were sufficiently great, spring 21 would be able to push rotor shaft 1 down sufficiently to close the gap. However, use of such a sufficiently strong spring 21 would cause a stronger contact force on all the sealing surfaces than is desired, and the amount of start-up torque required to initiate rotation of the rotor shaft would be undesirably increased. As a unique feature of the present invention, an orifice 5 is provided to prevent a similar failure to restart from occurring. Orifice 5 is sized so that as fluid leaks more rapidly past lower mechanical face seal 15, pressure in pressure chamber 12 is reduced. This reduction in pressure causes a hydrostatic imbalance on rotor shaft 1 and seal head 4, forcing them downward so as to close the gap in lower mechanical face seal 15. When the set-down force is removed, rotor shaft 1 and seal head 4 return to their normal operating positions, and shaft rotation resumes. Any abrasive particles larger than orifice 5 will be excluded from pressure chamber 12 and prevented from damaging mechanical face seals 15 and 17. Thus the present invention can be used in conjunction with working fluids including abrasive materials without damaging the sealing surfaces. While the size of orifice 5 is selected to ensure that a hydrostatic imbalance on the rotor exists during set down conditions, note that the orifice could be implemented as a plurality of small openings to filter any size particle desired. A single orifice ranging in size from about 0.010 inches to about 0.090 inches is expected to be useful both for filtering particles and ensuring that the rotor experiences a hydrostatic imbalance during set down conditions, although it should be understood that such sizes are merely exemplary, and are not intended to limit the invention.

Figure 4:
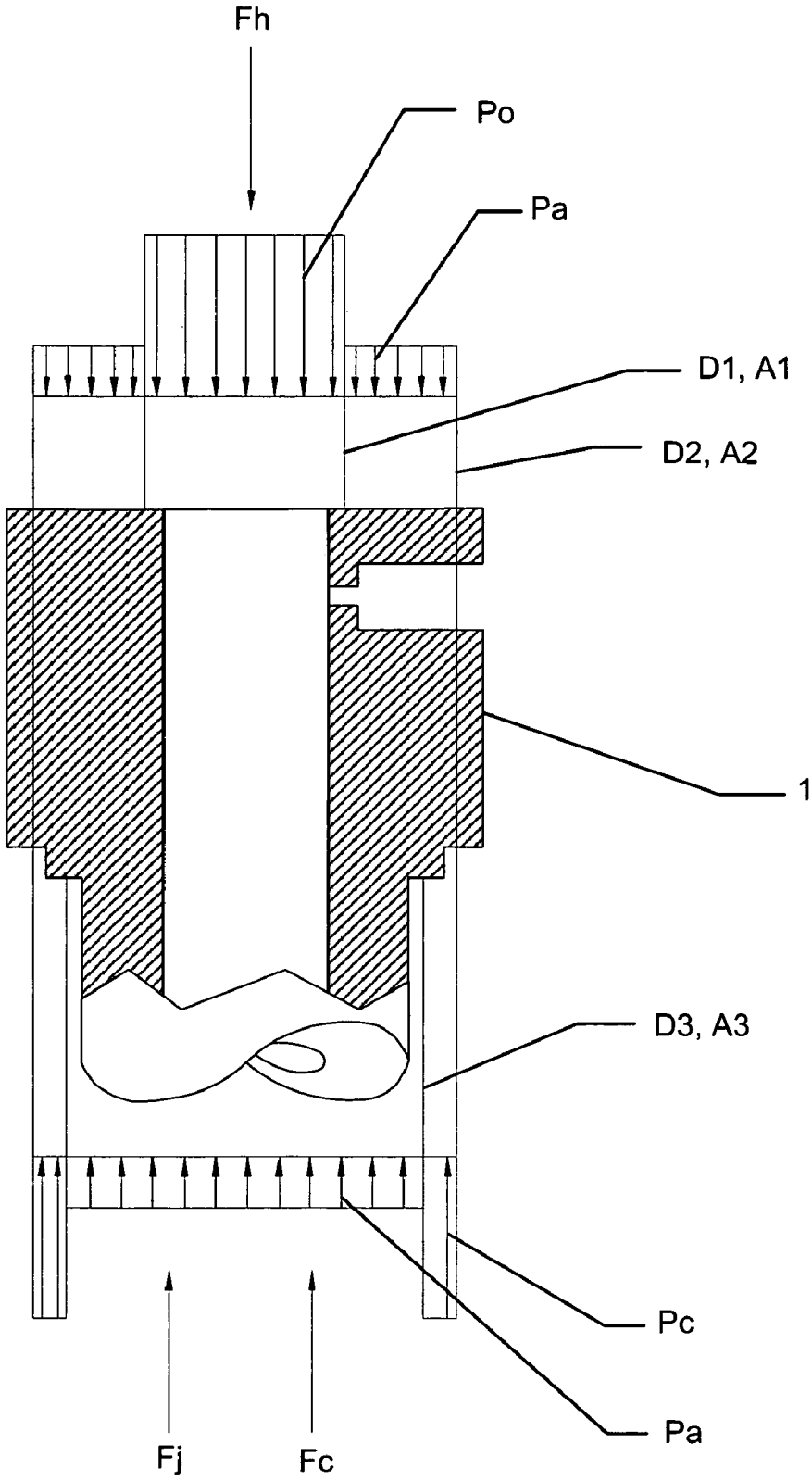
FIG. 4 is a free body diagram of the rotor, schematically depicting the forces acting on the rotor in the vertical direction (where "vertical" as used here and throughout this disclosure is in reference to the direction shown in this Figure and is not to be construed as an absolute direction)
Figure 5:
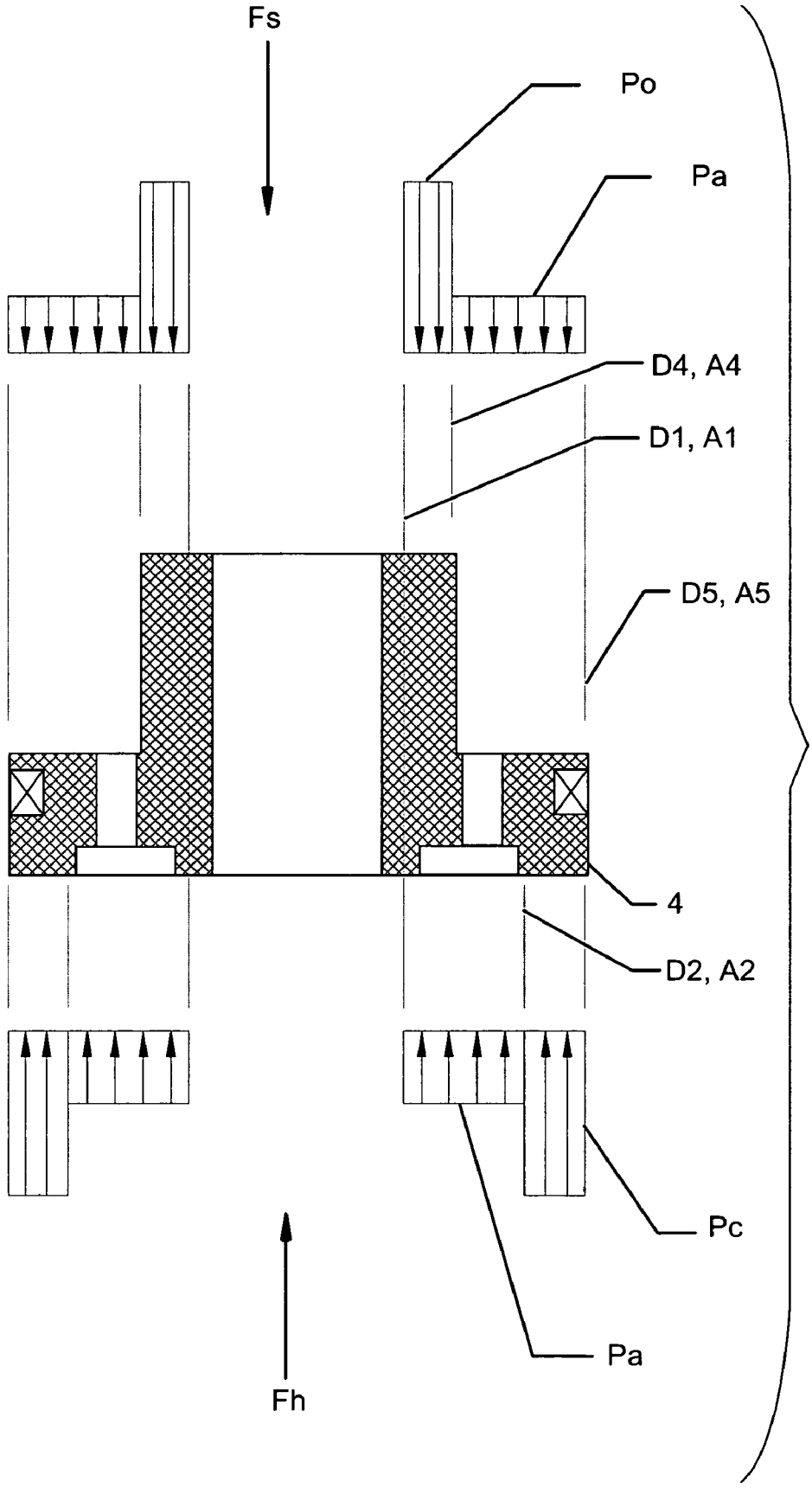
FIG. 5 is a free body diagram of the seal head, schematically depicting the forces acting on the seal head in the vertical direction.

Referring to FIG. 4, it will be apparent that a number of external forces act on rotor shaft 1. These forces are large relative to other forces, such as gravity or acceleration, and accordingly, these other forces will be neglected in the following analysis. The following equation sums the forces in the vertical direction:

$$Pa*A3+Pc*(A2-A3)+Fj+Fc-Pa*(A2-A1)-Po*A1-Fh=0 \quad (1)$$

where:

Fj is the vertical component of the jet reaction force

Fc is the contact force between the rotor shaft and housing

Fh is the contact force between the rotor shaft and seal head

Po is the inlet pressure to the rotor assembly

Pa is the ambient pressure surrounding the rotor assembly

Pc is the pressure in the pressure chamber

D1 and A1 are the effective sealing diameter and area of upper inner seal 16

D2 and A2 are the effective sealing diameter and area of upper outer seal 17

D3 and A3 are the effective sealing diameter and area of lower seal 15

The force exerted by the spring is nominal compared to the other forces indicated, and therefore has not been included.

The areas and diameters in this analysis are simply a representation of the effective sealing diameters and areas of the seals. These seals have flat parallel faces with constant gap thickness, so the pressure varies linearly from the inner radius to the outer radius. It will be understood that for a given radius, or diameter of the seals, under the condition that a high pressure exists on one side of the radius and low pressure exists on the other, the effective sealing radius, or diameter, is taken to be at the average radius the sealing face.

Assuming Po and Pc are taken relative to Pa, and setting Pa equal to zero, the force balance equation reduces to:

$$Pc*(A2-A3)+Fj+Fc-Po*A1-Fh=0 \quad (2)$$

During normal operation the pressure Pc in pressure chamber 12 is equal to the inlet pressure Po. Substituting Po for Pc reduces the force balance equation to:

$$Po*(A2-A3-A1)+Fj+Fc-Fh=0 \quad (3)$$

The reaction force for a fluid jet is proportional to the pressure drop across the nozzle (Po) and the nozzle area (Aj). Accordingly, the expression can be rewritten as:

$$Fj=K*Po*Aj \quad (4)$$

where K is a constant. Substituting Equation 4 into Equation 3 yields the following:

$$Po*(A2-A3-A1+K*Aj)+Fc-Fh=0 \quad (5)$$

In one preferred embodiment of the invention, the rotor shaft is held captive between the housing and seal head with equal contact force at the two ends, which implies that forces Fc and Fh are equal. In this case, the equilibrium equation becomes:

$$A2-A3-A1+K*Aj=0 \quad (6)$$

The above equation shows that, for a given jetting configuration, if two selected effective sealing areas are chosen, the third sealing area, and therefore the diameter of the third seal, can be calculated to produce any desired contact force between the stationary and rotating elements. In a preferred embodiment, diameter D3 is maximized to reduce the flow velocity, pressure differential, and turbulence into reservoir 20 of nozzle head 2. Diameter D2 is made larger than diameter D3, within geometric constraints of the system. Diameter D1 is then sized to produce a light contact load on the lower seal when the largest expected nozzle combination is used.

Referring to FIG. 3, it will also be apparent that a number of external forces act on seal head 4. The following equation sums the forces in the vertical direction:

$$Fh+Pa*(A2-A1)+Pc*(A5-A2)-Fs-Po*(A4-A1)-Pa*(A5-A4)=0 \quad (7)$$

where:

Fh is the contact force between the rotor shaft and seal head

Fs is the spring force on the back of the seal head

Po is the inlet pressure to the rotor assembly

Pa is the ambient pressure surrounding the rotor assembly

Pc is the pressure in the pressure chamber

A1 is the effective sealing area of the upper inner seal

A2 is the effective sealing area of the upper outer seal

A4 is the sealing area of secondary seal 1

A5 is the sealing area of secondary seal 2.

Making similar assumptions as before, the force balance equation reduces to:

$$Fh-Fs+Po*[(A5-A2)-(A4-A1)]=0 \quad (8)$$

The contact force between the seal head and rotor shaft is then:

$$Fh=Fs+Po*[(A4-A1)-(A5-A2)] \quad (9)$$

The values of A1 and A2, and therefore, D1 and D2, are determined as described above to balance the forces on the rotor shaft. The values of A4 and A5, and therefore, D4 and D5, can be selected so that the contact force is proportional to the working pressure, and the constant of proportionality can be positive, zero, or negative. These diameters are selected to impart a small positive force, Fh, as a function of pressure, so that seal head 4 and rotor shaft 1 remain in contact. By careful selection of these diameters, the contact force can be kept small enough that the torque produced by the fluid jet(s) can overcome the static friction torque from the contact between rotor shaft 1 and housing 3, as well as from the contact between rotor shaft 1 and seal head 4.

Figure 6:
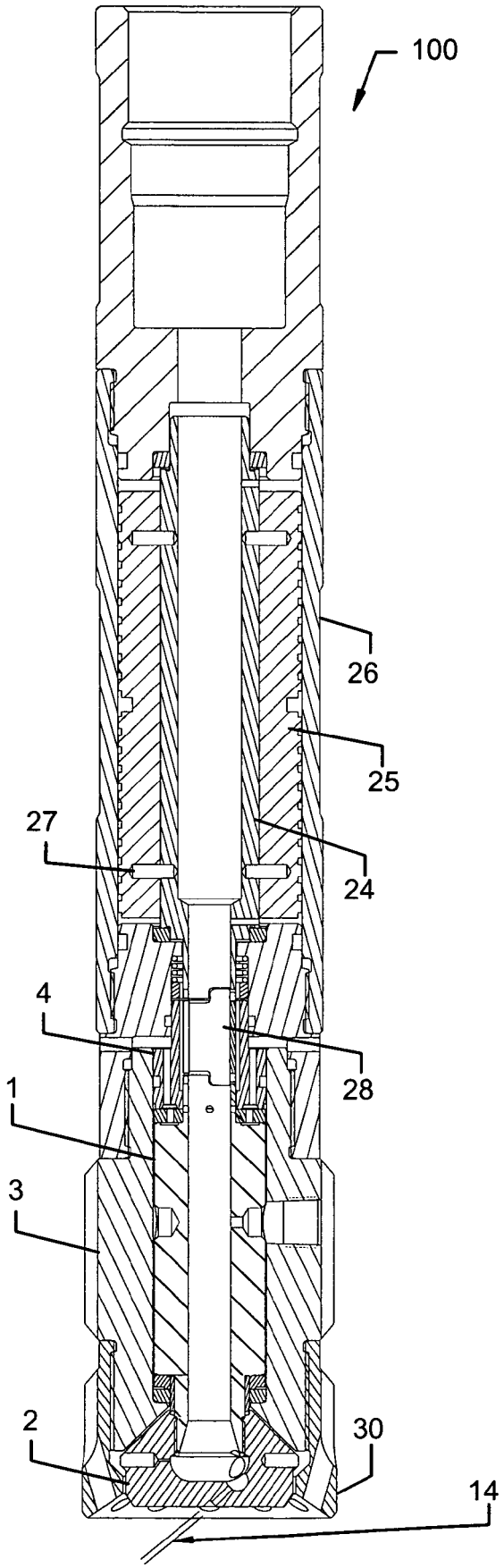
FIG. 6 is a cross-sectional side view of a working model of the preferred embodiment of the rotary jetting tool in accord with the present invention, including a power take off system and a braking system.

If rotor shaft 1 were allowed to spin unrestrained at full pressure, the rotation speed would be very high, causing excessive wear of the sealing components. To prevent this problem, a braking apparatus is included in one preferred embodiment of the present invention, as explained below. Referring to FIG. 6, a rotary jetting tool 100 includes centrifugally actuated mechanical friction brakes. It should be understood however, that a number of alternative braking mechanisms could instead be used. Some possible alternatives include, but are not limited to, braking mechanisms based on magnetic properties, viscous fluids, and fluid kinetics. Torque produced by fluid jet 14 is transmitted to a brake shaft 24, through a coupling 28. Coupling jaws in the back of rotor shaft 1 mate with jaws in coupling 28, and a similar mating is provided between the coupling and brake shaft. Torque is transmitted from brake shaft 24 to brake shoes 25 through drive pins 27. The pin mounting is configured so that brake shoes 25 are free to move in the radial direction, but not in the axial or circumferential directions. The center of gravity of the brake shoes is eccentric relative to the axis of rotation, causing an increasing normal force between brake shoes 25 and a brake housing 26, as the rotational speed increases. Alternatively, the centrifugal brake shoes can be mounted in the same manner on rotor shaft 1, eliminating the need for coupling 28. Frictional force between the brake shoes and the brake housing thus limits the rotational speed of the assembly. The inner surface of the brake housing is preferably lined with a hard material, such as cemented tungsten carbide, to limit wear of the housing.

In one preferred embodiment of the invention, the rotary jet head is protected by a circular gage ring 30 that is coupled to housing 3. The gage ring is forced into contact with the formation to be drilled or material to be removed from a tube. Coiled tubing and jointed tubing systems are commonly lowered or pushed into a well with a system that is equipped to monitor the force on the working end of the tubing. When the force rises, the operator knows that the tool is in contact with the formation in the borehole. The gage ring prevents any further advance of the tool until all of the material ahead of the gage ring is removed. This approach enables drilling of a near gage circular hole in rock. Gage ring 30 also generally protects nozzle head 2 from coming into contact with the formation. In the event that the applied force is too high, the rotating head may contact the formation anyway. When nozzle head 2 contacts the formation, it will be pushed back, and the back face of nozzle head 2 will come into contact with housing 3 (i.e., gap 22 will be eliminated by the movement of nozzle head 2). The axial movement of nozzle head 2 and rotor shaft 1 causes lower mechanical face seal 15 to leak. This leakage is accompanied by a loss of fluid pressure when pumping fluid at a fixed flow rate. The operator thus has an indication that the rotor head has contacted the formation and stalled. The force on the tool may then be reduced or the tool may be pulled away from bottom of the borehole to address the problem.

Figure 7:
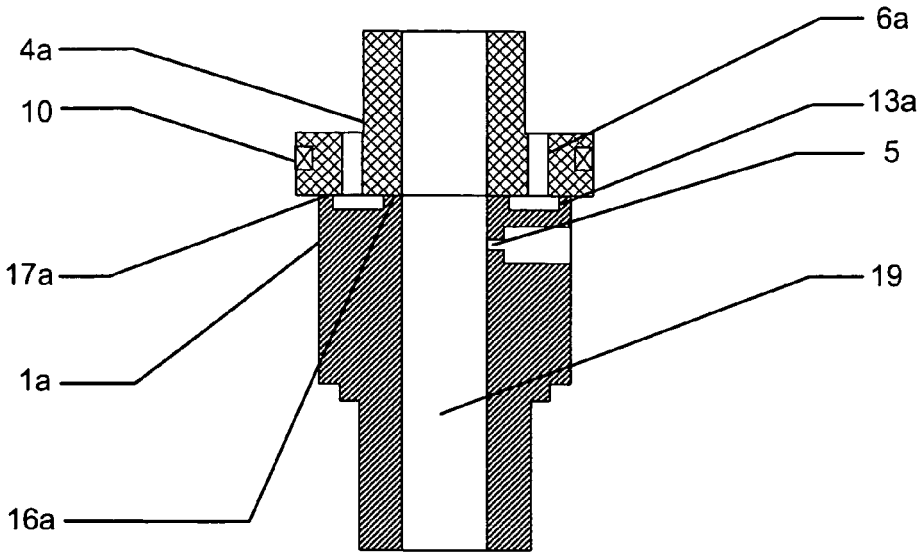
FIG. 7 is a cross-sectional side view of an alternative embodiment of a seal head and rotor shaft, wherein a mid face vent for an upper mechanical face seal is implemented using an annular volume formed in the rotor shaft, instead of the seal head.
Figure 8A:
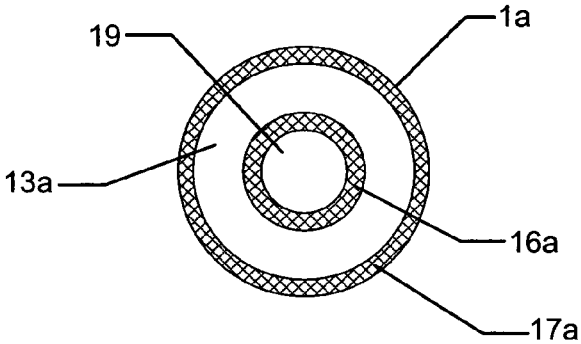
FIG. 8A is a plan view of the rotor shaft of FIG. 7, showing the annular recess separating the upper mechanical face seal into an inner mechanical face seal and an outer mechanical face seal.
Figure 8B:
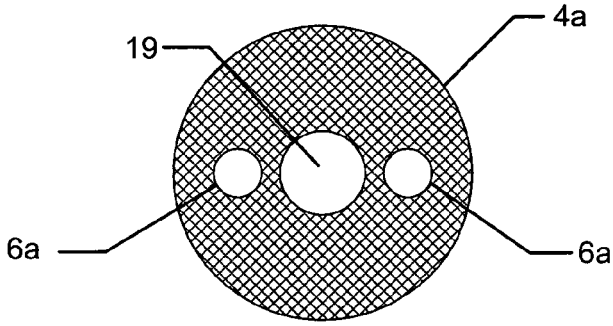
FIG. 8B is a bottom view of the seal head of FIG. 7, showing the vent passages used to couple the annular recess formed in the rotor shaft of FIG. 8A in fluid communication with an ambient pressure.

The embodiment described above achieves the vented upper mechanical face seal by forming an annual recess in the seal head. An alternative embodiment achieves a similar vented upper mechanical face seal by forming an annular recess in the proximal face of the rotor shaft. This latter embodiment is schematically illustrated in FIGS. 7–8C, which illustrate details related to the modifications to the seal head and rotor shaft described above. Other portions of this alternative rotary jetting tool remain unchanged, with respect to the embodiment shown in FIG. 1.

FIG. 7 is a cross-sectional side view of a modified seal head 4*a* and a modified rotor shaft 1*a*. The annular volume defining a mid face vent cavity 13*a* is formed as a recess in rotor shaft 1*a*. The length of venting passages 6*a* formed into seal head 4*a* has been increased relative to the length of vents passages 6 formed into seal head 4, because there is no vent cavity 13 formed into seal head 4*a*. A vented upper mechanical face seal is achieved when seal head 4*a* and rotor shaft 1*a* are engaged in housing 3 (see FIG. 1), the vented upper mechanical face seal including an upper inner mechanical face seal 16*a* and an upper outer mechanical face seal 17*a*.

In another embodiment of the present invention, a rotary jetting tool includes a pressure-balanced lower mechanical face seal configured to reduce a startup torque required to initiate rotation of the rotor and nozzles. The embodiments described above have reduced the startup torque required by using a vented upper mechanical face seal, which results in an area of low pressure being disposed proximate a proximal end of the rotor. This lower pressure area above the rotor reduces a startup torque required by reducing the force exerted by the operating fluid on the rotor. A similar reduction in the startup torque can be achieved by pressure balancing the lower mechanical face seal, instead of by venting the upper mechanical face seal. Pressure balancing the lower mechanical face seal to reduce startup torque is a accomplished by providing a volume of relatively high pressure in fluid communication with the lower mechanical face seal. This volume of relatively high pressure will in part counteract the force exerted on the rotor by the column of working fluid disposed proximal of the rotor. In short, the column of working fluid above the rotor provides a force that loads the lower mechanical face seal. This force can be offset in part by providing a volume of relatively lower pressure adjacent to the upper mechanical face seal, or by providing a volume of relatively high pressure adjacent to the lower mechanical face seal.

FIG. 9A is a cross-sectional side view of a rotary jetting tool incorporating a pressure balanced lower mechanical face seal. An annular recess 13*b* is formed in a distal face of a rotor shaft 1*b* to achieve a pressure-balanced lower mechanical face seal that is configured to reduce the startup torque required to initiate rotation of the rotor and nozzles. Annular recess 13*b* is coupled in fluid communication with passage 19 via an orifice 5*a*, and a fluid passage 6*a*, such that annular recess 13*b* is filled with high-pressure working fluid during normal operating conditions. The high-pressure working fluid in annular recess 13*b* exerts an upward force on rotor shaft 1*b*, counteracting in part the downward force exerted on rotor shaft 1*b* by the column of operating fluid disposed above the rotor shaft (i.e., by the operating fluid above fluid inlet passage 18). Note that in this embodiment, the seal head required is simpler than the seal heads required in the embodiments described above. A seal head 4*b* includes neither an annular recess, nor fluid ports coupled in fluid communication with an ambient volume. Only a single secondary seal 9 is required (note that the embodiments described above include a mid-face vented upper mechanical face seal with two secondary seals—secondary seal 9, and secondary seal 10). Seal head 4*b* includes an axial volume for the working fluid (i.e., passage 19), and a distal face configured to sealingly engage rotor shaft 1*b*. Spring 21 is included, and as described above, exerts a relatively light downward force on seal head 4*b* and rotor shaft 1*b* to ensure that the upper and lower mechanical face seals do not leak, even when no working fluid is exerting a downward force on the seal head and rotor shaft.

An upper mechanical face seal 16*b* is achieved between a distal face of seal head 4*b* and a proximal face of rotor shaft 1*b*. A lower mechanical face seal is achieved between a distal annular face of rotor shaft 1*b* and housing 3. Annular recess 13*b* separates the lower mechanical face seal into an inner lower mechanical face seal 15*a* and an outer lower mechanical face seal 15*b*. As discussed above, ultra-hard surfaces can be used to implement each sealing face, and it is particularly preferred that each face in a sealing face pair be implemented using a different type of ultra-hard art material.

In the embodiment illustrated in FIG. 9A, a pressure chamber 12*a* is vented to ambient volume by a passage 7*a*. In the embodiments described above that includes a vented upper mechanical face seal, passage 7 couples take-up chamber 23 in fluid communication with an ambient volume. In the above-described embodiments including the vented upper mechanical face seals, pressure chamber 12 is filled with high-pressure working fluid during normal operating conditions. In contrast, in the embodiment of FIG. 9A, pressure chamber 12*a* is vented to ambient pressure during normal operating conditions, and is not filled with high pressure working fluid.

FIG. 9B is a cross-sectional side view of the rotary jetting tool of FIG. 9A in a set-down condition, clearly illustrating how pressurized working fluid introduced into annular recess 13*b* during normal operating conditions escapes through orifice 3*a* during set-down conditions, where nozzle head 2, rotor shaft 1*b*, and seal head 4*b* are forced upward. The size of orifice 5*a* is empirically selected to ensure that rotor shaft 1*b* is exposed to an imbalanced pressure load during set down conditions, such that when the rotary jetting tool is backed off the obstruction, causing the nozzle head, the rotor shaft, and the seal head to be forced upwards, the pressure imbalance forces rotor shaft 1*b* to move downwardly, so that the lower mechanical face seal is reestablished. Such a pressure imbalance ensures that the column of working fluid above seal head 4*b* and rotor shaft 1*b* will force the nozzle head, the rotor shaft, and the seal head to return to their normal positions, once the rotary jetting tool has been backed off the obstruction. Orifice 5*a* also prevents any abrasive particles that are larger than the orifice from entering annular recess 13*b*. Abrasive larger than this size can therefore be pumped without accumulating in annular recess 13*b*, where they could otherwise damage inner lower mechanical face seal 15*a* and outer lower mechanical face seal 15*b*. Note that in FIG. 9B, gap 22 is indicated with a dashed tag line, because the gap is closed. The tag lines for inner lower mechanical face seal 15*a* and outer lower mechanical face seal 15*b* are similarly indicated as dashed lines, because in the set down condition the lower mechanical face seals are open (i.e. the rotor is not sealingly engaging the housing). The tag lines for take-up chamber 23 in FIGS. 9A, 9B and 10 are indicated as dashed lines, to emphasize the difference between the rotary jetting tools of FIGS. 9A, 9B and 10 (which do not include take-up chamber 23) and the rotary jetting tools of FIGS. 1 and 2 (which do include take-up chamber 23).

FIG. 10 is a cross-sectional side view of still another embodiment of a rotary jetting tool in accord with the present invention, in which an annular recess utilized to achieve a pressure balanced lower mechanical face seal is formed in the housing adjacent to the distal face of the rotor shaft, as opposed to being formed in the rotor shaft. An annular recess 13*c* is formed in a housing 3*b*, such that a lower mechanical face seal is achieved between housing 3*b* and a distal annular face of a rotor shaft 1*c*. Annual recess 13*c* thus separates the lower mechanical face seal into an inner lower mechanical face seal 15*c*, and an outer lower face seal 15*d*. Annular recess 13*c* is coupled in fluid communication with passage 19 via an orifice 5*b* and a fluid passage 6*b*, such that annular recess 13*c* is filled with high-pressure fluid during normal operating conditions. As with the embodiment illustrated in FIGS. 9A and 9B, the high-pressure fluid in annular recess 13*c* exerts an upward force on rotor shaft 1*c*, counteracting in part the downward force exerted on rotor shaft 1*c* by the column of operating fluid disposed about the rotor (i.e., by the operating fluid above fluid inlet passage 18). As described above, the size of orifice 5*b* is empirically selected to ensure that rotor shaft 1*c* is exposed to an imbalanced pressure load during set-down conditions, so that when the rotary jetting tool is backed off the obstruction, the pressure imbalance forces rotor shaft 1*c* to move downwardly, to reestablish the lower mechanical face seal. Furthermore, ultra-hard surfaces (or two different types) are preferably used on the faces of the mechanical face seals, as described above.

Although the present invention has been described in connection with the preferred form of practicing it and modifications thereto, those of ordinary skill in the art will understand that many other modifications can be made to the present invention within the scope of the claims that follow. Accordingly, it is not intended that the scope of the invention in any way be limited by the above description, but instead be determined entirely by reference to the claims that follow.

The invention in which an exclusive right is claimed is defined by the following:

1. A rotary jetting apparatus comprising:

(a) a housing defining a fluid path for a pressurized fluid;

(b) a rotor, at least a portion of which is disposed coaxially within the housing, the rotor including a proximal end and a distal end, the rotor being configured to rotate relative to the housing, a distal surface of the rotor sealingly engaging the housing;

(c) at least one nozzle in fluid communication with the fluid path, the at least one nozzle being disposed proximate the distal end of the rotor and being configured to rotate in unison with the rotor, and to discharge a jet of the pressurized fluid;

(d) a seal head disposed within the housing adjacent to the proximal end of the rotor, so that the seal head does not rotate relative to the housing, the seal head including a distal face that sealingly engages the proximal end of the rotor;

(e) at least one of an upper mechanical face seal and a lower mechanical face seal; and (f) a volume disposed adjacent to one of the upper mechanical face seal and the lower mechanical face seal, the volume being coupled to a pressure at startup that reduces an amount of torque required to initiate rotation of the rotor, by reducing a friction acting on the rotor.

2. The rotary jetting apparatus of claim 1, wherein:

(a) the upper mechanical face seal comprises a sealing engagement between the seal head and the rotor;

(b) the volume is disposed adjacent to the upper mechanical face seal; and (c) the volume is coupled in fluid communication with a region external to the housing.

3. The rotary jetting apparatus of claim 2, wherein the balance ratio is less than about 0.65.

4. The rotary jetting apparatus of claim 2, wherein the volume separates the upper mechanical face seal into an inner mechanical face seal and an outer mechanical face seal.

5. The rotary jetting apparatus of claim 4, wherein the volume is defined by an annular recess formed in the proximal end of the rotor.

6. The rotary jetting apparatus of claim 4, wherein the volume is defined by an annular recess formed in the distal face of the seal head.

7. The rotary jetting apparatus of claim 2, further comprising a pressure chamber substantially encompassing the rotor, the pressure chamber being filled with a pressurized working fluid during a normal operation of the rotary jetting apparatus.

8. The rotary jetting apparatus of claim 7, wherein the pressure chamber is defined by the housing, the rotor, the upper mechanical face seal, and the lower mechanical face seal.

9. The rotary jetting apparatus of claim 7, wherein the rotor and the seal head are enabled to move axially relative to the housing, to open the lower mechanical face seal, so that pressurized fluid in the pressure chamber escapes.

10. The rotary jetting apparatus of claim 9, further comprising an orifice that couples the pressure chamber in fluid communication with the fluid path, the orifice being sized to cause a hydrostatic imbalance on the rotor whenever the lower mechanical face seal is open, the hydrostatic imbalance forcing the rotor and seal head to move axially relative to the housing, to close the lower mechanical face seal.

11. The rotary jetting apparatus of claim 10, wherein the orifice act as a filter that prevents abrasive particles larger in size than the orifice from passing through the orifice and damaging the upper mechanical face seal and the lower mechanical face seal, such abrasive particles being entrained in a pressurized fluid in the fluid path.

12. The rotary jetting apparatus of claim 7, wherein the rotor comprises an orifice that couples the pressure chamber in fluid communication with the fluid path, the orifice being sized to cause a hydrostatic imbalance on the rotor during set-down conditions.

13. The rotary jetting apparatus of claim 2, wherein the distal surface of the rotor comprises a radial surface, the radial surface sealingly engaging the housing to achieve a radial clearance seal.

14. The rotary jetting apparatus of claim 1, wherein:

(a) the lower mechanical face seal comprises a sealing engagement of the distal surface of the rotor and the housing;

(b) the volume is disposed adjacent to the lower mechanical face seal; and (c) the volume is coupled in fluid communication with a pressurized working fluid during normal operation.

15. The rotary jetting apparatus of claim 14, wherein the volume separates the lower mechanical face seal into an inner mechanical face seal and an outer mechanical face seal.

16. The rotary jetting apparatus of claim 15, wherein the volume is defined by an annular recess formed in the distal surface of the rotor.

17. The rotary jetting apparatus of claim 15, wherein the volume is defined by an annular recess formed in a distal end of the housing.

18. The rotary jetting apparatus of claim 14, farther comprising a pressure chamber substantially encompassing the rotor, the pressure chamber being coupled in fluid communication with a region external to the housing.

19. The rotary jetting apparatus of claim 14, wherein the rotor and the seal head are enabled to move axially relative to the housing, to open the lower mechanical face seal, so that pressurized fluid in the volume escapes.

20. The rotary jetting apparatus of claim 19, further comprising an orifice that couples the volume in fluid communication with the fluid path, the orifice being sized to cause a hydrostatic imbalance on the rotor whenever the lower mechanical face seal is open, the hydrostatic imbalance forcing the rotor and seal head to move axially relative to the housing, to close the lower mechanical face seal.

21. The rotary jetting apparatus of claim 19, wherein the orifice act as a filter that prevents abrasive particles larger in size than the orifice from passing through the orifice and damaging the lower mechanical face seal, such abrasive particles being entrained in a pressurized fluid in the fluid path.

22. The rotary jetting apparatus of claim 1, further comprising a braking mechanism, to limit a rotational rate of the rotor.

23. The rotary jetting apparatus of claim 1, wherein at least one of the following is true:

(a) the at least one nozzle is oriented and configured to discharge a jet of the pressurized fluid in a direction selected to impart a rotary torque to the rotor; and (b) the rotor is configured to be rotated by a motor disposed external to the housing.

24. The rotary jetting apparatus of claim 1, wherein the upper mechanical face seal comprises a mid-faced vent that reduces a pressure acting on the upper mechanical face seal, to reduce an amount of torque required to initiate rotation of the rotor.

25. The rotary jetting apparatus of claim 24, wherein the mid-faced vent is ported to an ambient pressure region.

26. The rotary jetting apparatus of claim 1, further comprising a nozzle head coupled to a distal end of the rotor, the nozzle head comprising the at least one nozzle, the nozzle head, rotor, and seal head being enabled to move axially relative to the housing, by an amount determined by a gap separating the nozzle head from the housing.

27. The rotary jetting apparatus of claim 1, further comprising a gage limiting ring coupled to a distal end of the housing, the gage limiting ring being configured to limit a forward motion of the rotary jetting apparatus until substantially all material disposed immediately distal of the gage limiting ring has been removed.

28. The rotary jetting apparatus of claim 1, further comprising a gage ring coupled to a distal end of the housing, the gage ring being configured to prevent the at least one nozzle from directly contacting a material disposed adjacent to a distal end of the rotary jetting tool.

29. The rotary jetting apparatus of claim 1, wherein opposing seal faces in each mechanical face seal are fabricated from pairs of dissimilar hard materials.

30. The rotary jetting apparatus of claim 29, wherein at least one of the pair of dissimilar hard materials comprises at least one of silicon carbide, diamond, tungsten carbide, boron carbide, and composites thereof.

31. A rotary jetting tool comprising:

(a) a housing defining a fluid path for a pressurized fluid;

(b) a rotor, at least a portion of which is disposed within the housing, the rotor including a proximal end and a distal end, a distal surface of the rotor being configured to sealingly engage the housing to achieve a lower mechanical face seal;

(c) at least one nozzle in fluid communication with the fluid path, the at least one nozzle being disposed proximate the distal end of the rotor, the at least one nozzle being configured to rotate together with the rotor, and to discharge a jet of the pressurized fluid;

(d) a seal head disposed within the housing adjacent to the proximal end of the rotor and configured so that the seal head does not rotate relative to the housing, the seal head having a distal face configured to sealingly engage the proximal end of the rotor to achieve an upper mechanical face seal; and (e) a volume coupled to a pressure at startup that reduces an amount of torque required to initiate rotation of the rotor, by reducing a friction acting on the rotor, the volume being disposed such that one of the following is true:

(i) the volume separates the lower mechanical face seal into an inner mechanical face seal and an outer mechanical face seal, the volume being coupled in fluid communication with the fluid path; and (ii) the volume separates the upper mechanical face seal into an inner mechanical face seal and an outer mechanical face seal, the volume being coupled in fluid communication with an ambient region that is external to the housing.

32. The rotary jetting tool of claim 31, further comprising a nozzle head including at least one nozzle in fluid communication with the fluid path, the at least one nozzle being configured to discharge a jet of pressurized fluid and being fixedly coupled to the rotor and rotating with the rotor, the nozzle head being disposed external to the housing, so that a gap separates the nozzle head from the housing, the gap defining an extent of axial movement of the rotor relative to the housing, wherein the volume is defined by an annular recess formed in the housing.

33. A rotary jetting tool comprising:

(a) a housing defining a fluid path for a pressurized fluid;

(b) a rotor, at least a portion of which is disposed within the housing, the rotor including a proximal end and a distal end, and being configured to rotate relative to the housing;

(c) at least one nozzle in fluid communication with the fluid path, the at least one nozzle being disposed proximate the distal end of the rotor, the at least one nozzle being configured to rotate together with the rotor, and to discharge a jet of the pressurized fluid;

(d) a seal head disposed within the housing adjacent the proximal end of the rotor and configured so that the seal head does not rotate relative to the housing, the seal head having a distal face configured to sealingly engage the proximal end of the rotor to achieve an upper mechanical face seal; and (e) a volume separating the upper mechanical face seal into an inner mechanical face seal and an outer mechanical face seal, the volume being coupled in fluid communication with an ambient region that is external to the housing, so that a pressure in the volume corresponding to the pressure in the ambient region reduces a torque required to initiate rotation of the rotor.

34. The rotary jetting tool of claim 33, wherein the volume is defined by an annular recess formed in the seal head.

35. The rotary jetting tool of claim 33, wherein the volume is defined by an annular recess formed in the rotor.

36. A rotary jetting tool comprising:

(a) a housing defining a fluid path for a pressurized fluid;

(b) a rotor, at least a portion of which is disposed within the housing, the rotor including a proximal end and a distal end, a distal surface of the rotor being configured to sealingly engage the housing to achieve a lower mechanical face seal;

(c) at least one nozzle in fluid communication with the fluid path, the at least one nozzle being disposed proximate to the distal end of the rotor, the at least one nozzle being configured to rotate together with the rotor, and to discharge a jet of the pressurized fluid;

(d) a seal head disposed within the housing adjacent to the proximal end of the rotor and configured so that the seal head does not rotate relative to the housing, the seal head having a distal face configured to sealingly engage the proximal end of the rotor to achieve an upper mechanical face seal; and (e) a volume separating the lower mechanical face seal into an inner mechanical face seal and an outer mechanical face seal, the volume being coupled in fluid communication with the fluid path, so that pressure in the volume corresponding to a pressure in the fluid path reduces a torque required to initiate rotation of the rotor.

37. The rotary jetting tool of claim 36, wherein the volume is defined by an annular recess formed in the rotor.

38. The rotary jetting tool of claim 36, wherein the volume is defined by an annular recess formed in the housing.

39. A rotary jetting tool comprising:

(a) a housing defining a fluid path for a pressurized fluid;

(b) a rotor, at least a portion of which is disposed coaxially within the housing, the rotor having a proximal end and a distal end and being configured to rotate relative to the housing, the rotor including an annular face configured to sealingly engage the housing, thereby effecting a lower mechanical face seal;

(c) a seal head disposed within the housing and configured so that the seal head does not rotate relative to the housing, the seal head having a distal face configured to sealingly engage the proximal end of the rotor, thereby effecting an upper mechanical face seal; and (d) a nozzle head including at least one nozzle in fluid communication with the fluid path, the at least one nozzle being configured to discharge a jet of pressurized fluid and being fixedly coupled to the rotor, so that the rotor and the nozzle head rotate together, the nozzle head being disposed external to the housing, so that a gap separates the nozzle head from the housing, the gap defining an extent of axial movement of the rotor relative to the housing.

40. A rotary jetting apparatus comprising:

(a) a housing defining a fluid path for a pressurized fluid;

(b) a pressure balancing head disposed within the housing so that the pressure balance head is enabled to move axially relative to the housing, but does not rotate relative to the housing, the pressure balancing head including:

(i) a first axial volume in fluid communication with the fluid path; and (ii) a distal face configured to function as an upper mechanical face seal;

(c) a rotor shaft, at least a portion of the rotor shaft being disposed within the housing, between a lower mechanical face seal and the upper mechanical face seal, so that the rotor shaft is able to move axially relative to the housing and can rotate relative to the housing, an axial movement of the rotor shaft opening a first gap in the lower mechanical face seal, the rotor shaft including:

(i) a second axial volume in fluid communication with the first axial volume;

(ii) a proximal face configured to rotatingly and sealingly engage the distal face of the pressure balancing head, to effect the upper mechanical face seal;

(iii) a lower annular face disposed distal to the proximal face, the lower annular face being configured to configured to rotatingly and sealingly engage the housing to achieve the lower mechanical face seal; and (iv) an orifice coupling the second axial volume in fluid communication with a pressure chamber defined by the housing, the rotor shaft, the upper mechanical face seal, the lower mechanical face seal, and the pressure chamber being configured so that pressurized fluid in the pressure chamber is enabled to escape through the first gap that is opened in the lower mechanical face seal in response to axial movement of the rotor shaft, the orifice having a size and shape selected to ensure a pressure imbalance occurring between the second axial volume and the pressure chamber forces the rotor shaft to move axially to automatically close and seal the first gap after the first gap has been opened; and (d) a nozzle head including at least one nozzle in fluid communication with the second axial volume, the at least one nozzle being configured to discharge a jet of pressurized fluid, the nozzle head being fixedly coupled to the rotor shaft, so that a rotation of the rotor shaft imparts a rotation to the nozzle head, and so that a rotation of the nozzle head imparts a rotation to the rotor shaft, the nozzle head being disposed external to the housing, so that a second gap separates the nozzle head from the housing, the second gap defining an extent of axial movement allowed the rotor shaft relative to the housing.

41. The rotary jetting apparatus of claim 40, wherein the distal face of the pressure balancing head comprises an annular recess coupled in fluid communication with an ambient volume external to the housing, the annular recess separating the upper mechanical face seal into an inner mechanical face seal and an outer mechanical face seal, and being coupled to a pressure that reduces an amount of torque required to initiate rotation of the rotor shaft.

42. The rotary jetting apparatus of claim 40, wherein the proximal face of the rotor shaft comprises an annular recess coupled in fluid communication with an ambient volume external to the housing, the annular recess separating the upper mechanical face seal into an inner mechanical face seal and an outer mechanical face seal, and being coupled to a pressure that reduces an amount of torque required to initiate rotation of the rotor shaft.

43. The rotary jetting apparatus of claim 40, wherein the lower annular face of the rotor shaft comprises an annular recess coupled in fluid communication with the second axial volume, the annular recess separating the lower mechanical face seal into an inner mechanical face seal and an outer mechanical face seal, and being coupled to a pressure that reduces an amount of torque required to initiate rotation of the rotor shaft.

44. The rotary jetting apparatus of claim 40, wherein the portion of the housing that sealing engages the lower annular face of the rotor shaft comprises an annular recess coupled in fluid communication with the second axial volume, the annular recess separating the lower mechanical face seal into an inner mechanical face seal and an outer mechanical face seal, and being coupled to a pressure that reduces an amount of torque required to initiate rotation of the rotor shaft.

45. A method for reducing a start-up torque required to initiate a rotation of a rotary jetting tool, the method comprising the steps of:

(a) effecting a mechanical face seal between a rotatable portion of the rotary jetting tool and a non-rotating portion of the rotary jetting tool; and (b) one of the steps of:

(i) coupling a volume adjacent to the mechanical face seal to a source of ambient pressure that reduces a frictional drag between the rotatable portion and the non-rotating portion of the rotating jetting tool at startup of the rotary jetting tool, thus reducing a start-up torque when initiating a rotation of the rotary jetting tool; and (ii) coupling a volume adjacent to the mechanical face seal to a source of pressurized fluid that reduces a frictional drag between the rotatable portion and the non-rotating portion of the rotating jetting tool at startup of the rotary jetting tool, thus reducing a start-up torque when initiating a rotation of the rotary jetting tool.

46. The method of claim 45, wherein the step of coupling the volume to a source of ambient pressure comprises the steps of:

(a) forming an annular recess in a face of the non-rotating portion of the rotating jetting tool that sealingly engages the rotating portion of the rotary jetting tool to achieve the volume; and (b) coupling the annular recess in fluid communication with the source of the ambient pressure.

47. The method of claim 45, wherein the step of coupling the volume to a source of ambient pressure comprises the steps of:

(a) forming an annular recess in a face of the rotating portion of the rotating jetting tool that sealingly engages the rotating portion of the rotary jetting tool to achieve the volume; and (b) coupling the annular recess in fluid communication with the source of the ambient pressure.

48. The method of claim 45, wherein the step of coupling the volume to a source of pressurized fluid comprises the steps of:

(a) forming an annular recess in a face of the non-rotating portion of the rotating jetting tool that sealingly engages the rotating portion of the rotary jetting tool to achieve the volume; and (b) coupling the annular recess in fluid communication with the source of the pressurized fluid.

49. The method of claim 45, wherein the step of coupling the volume to a source of pressurized fluid comprises the steps of:

(a) forming an annular recess in a face of the rotating portion of the rotating jetting tool that sealingly engages the rotating portion of the rotary jetting tool to achieve the volume; and (b) coupling the annular recess in fluid communication with the source of the pressurized fluid.

50. The method of claim 45, wherein the step of coupling the volume to a source of pressurized fluid comprises the step of providing an orifice separating the volume from the source of the pressurized fluid, such that abrasive particles entrained within the pressurized fluid which are larger in size than the orifice are prevented from damaging the mechanical face seal.

51. The method of claim 45, wherein the mechanical face seal is in fluid communication with the pressurized fluid, and further comprising the step of providing an orifice between the at least a portion of the mechanical face seal and the source of the pressurized fluid, such that abrasive particles entrained within the pressurized fluid which are larger in size than the orifice are prevented from damaging that portion of the mechanical face seal.

52. A method for drilling a circular hole in a material, comprising the steps of:

(a) placing a rotary jetting tool adjacent to a material into which a hole is to be drilled, the rotary jetting tool including at least one nozzle configured to rotate and to emit a jet of a pressurized fluid for drilling the material;

(b) supplying the pressurized fluid to the rotary jetting tool, such that the at least one nozzle emits the jet of pressurized fluid;

(c) advancing the rotary jetting tool toward the material until a gage ring on the rotary jetting tool contacts the material into which the hole is to be drilled, preventing the at least one nozzle from directly contacting the material, while monitoring a pressure of the pressurized fluid supplied to the rotary jetting tool, such that a drop in the pressure indicates that the gage ring has contacted the material, the drop in pressure being caused by a seal within the rotary jetting tool opening in response to an axial movement of the rotary jetting tool relative to the gage ring, when the gage ring contacts the material; and (d) applying a constant force to the rotary jetting tool so that the gage ring remains in contact with the material into which the hole is to be drilled, removal of portions of the material disposed immediately adjacent to the gage ring enabling the rotary jetting tool to advance into the material to drill the hole.

53. The method of claim 52, wherein the step of supplying the pressurized fluid to the rotary jetting tool comprises the step of using a constant displacement pump to pressurize the pressurized fluid.

54. The method of claim 52, wherein the step of supplying the pressurized fluid to the rotary jetting tool comprises the step of using a tube to convey the pressurized fluid from a remote source to the rotary jetting tool.

55. The method of claim 52, wherein the material comprises at least one of rock, soil, and a geologic formation.

56. A method for drilling a circular hole in a material, comprising the steps of:

(a) placing a rotary jetting tool adjacent to a material into which a hole is to be drilled, the rotary jetting tool including at least one nozzle configured to rotate and to emit a jet of a pressurized fluid for drilling the material;

(b) supplying the pressurized fluid to the rotary jetting tool using a tube to convey the pressurized fluid from a remote source to the rotary jetting tool, such that the at least one nozzle emits the jet of pressurized fluid;

(c) advancing the rotary jetting tool toward the material until a gage ring on the rotary jetting tool contacts the material into which the hole is to be drilled, preventing the at least one nozzle from directly contacting the material, while monitoring a force resisting advancement of the tube, such that an increase in the force indicates that the gage ring has contacted the material; and (d) applying a constant force to the rotary jetting tool so that the gage ring remains in contact with the material into which the hole is to be drilled, removal of portions of the material disposed immediately adjacent to the gage ring enabling the rotary jetting tool to advance into the material to drill the hole.

57. A method for drilling a circular hole in a material, comprising the steps of:

(a) placing a rotary jetting tool adjacent to a material into which a hole is to be drilled, the rotary jetting tool including at least one nozzle configured to rotate and to emit a jet of a pressurized fluid for drilling the material;

(b) supplying the pressurized fluid to the rotary jetting tool, such that the at least one nozzle emits the jet of pressurized fluid;

(c) advancing the rotary jetting tool toward the material until a gage ring on the rotary jetting tool contacts the material into which the hole is to be drilled, preventing the at least one nozzle from directly contacting the material;

(d) applying a constant force to the rotary jetting tool so that the gage ring remains in contact with the material into which the hole is to be drilled, removal of portions of the material disposed immediately adjacent to the gage ring enabling the rotary jetting tool to advance into the material to drill the hole; and (e) pressure balancing an upper mechanical face seal and a lower mechanical face seal in the rotary jetting tool, the upper mechanical face seal and the lower mechanical face seal being axially opposed.

58. The method of claim 57, wherein at least one of the upper mechanical face seal and the lower mechanical face seal is in fluid communication with the pressurized fluid, and further comprising the step of providing an orifice between the at least one of the upper mechanical face seal and the lower mechanical face seal and the source of the pressurized fluid, such that abrasive particles entrained within the pressurized fluid which are larger in size than the orifice are prevented from passing through the orifice and damaging the at least one of the upper mechanical face seal and the lower mechanical face seal.

59. The method of claim 57, further comprising the step of coupling an annular recess in the upper mechanical face seal in fluid communication with an ambient region that is external to the rotary jetting tool, the annular recess separating the upper mechanical face seal into an inner mechanical face seal and an outer mechanical face seal, a pressure in the annular recess that corresponds to that of the ambient region acting to reduce a torque required to initiate rotation of the at least one nozzle.

60. The method of claim 57, further comprising the step of coupling an annular recess in the lower mechanical face seal in fluid communication with a source of the pressurized fluid, the annular recess separating the upper mechanical face seal into an inner mechanical face seal and an outer mechanical face seal, a pressure in the annular recess that corresponds to that of the pressurized fluid acting to reduce a torque required to initiate rotation of the at least one nozzle.

61. A method for removing foreign material from a tube, comprising the steps of:

(a) introducing a rotary jetting tool into the tube, the rotary jetting tool including at least one nozzle configured to rotate within the tube and to emit a jet of pressurized fluid;

(b) supplying a pressurized fluid to the rotary jetting tool, such that the at least one nozzle emits a jet of pressurized fluid;

(c) advancing the rotary jetting tool until a gage ring on the rotary jetting tool contacts the foreign material to be removed, the gage ring being configured to prevent the at least one nozzle from directly contacting the foreign material to be removed, while monitoring a pressure of the pressurized fluid supplied to the rotary jetting tool to detect a drop in the pressure, the drop in pressure indicating that the gage ring has contacted the material, the drop in pressure being caused by a seal within the rotary jetting tool opening in response to axial movement of the rotary jetting tool relative to the gage ring caused by the gage ring contacting the foreign material; and (d) applying a constant force to advance the rotary jetting tool through the tube, so that the gage ring remains in contact with the foreign material to be removed, removal of portions of such foreign material enabling the rotary jetting tool to advance farther into the tube.

62. The method of claim 61, wherein the step of supplying the pressurized fluid to the rotary jetting tool comprises the step of using a constant displacement pump to produce the pressurized fluid.

63. The method of claim 61, wherein the step of supplying the pressurized fluid to the rotary jetting tool comprises the step of conveying the pressurized fluid from a remote source to the rotary jetting tool along a fluid path.

64. A method for removing foreign material from a tube, comprising the steps of:

(a) introducing a rotary jetting tool into the tube, the rotary jetting tool including at least one nozzle configured to rotate within the tube and to emit a jet of pressurized fluid;

(b) supplying a pressurized fluid to the rotary jetting tool, such that the at least one nozzle emits a jet of pressurized fluid;

(c) advancing the rotary jetting tool until a gage ring on the rotary jetting tool contacts the foreign material to be removed, the gage ring being configured to prevent the at least one nozzle from directly contacting the foreign material to be removed, while monitoring a force applied to advance the rotary jetting tool through the tube, an increase in the force indicating that the gage ring has contacted the foreign material; and (d) applying a constant force to advance the rotary jetting tool through the tube, so that the gage ring remains in contact with the foreign material to be removed, removal of portions of such foreign material enabling the rotary jetting tool to advance farther into the tube.

65. A method for removing foreign material from a tube, comprising the steps of:

(a) introducing a rotary jetting tool into the tube, the rotary jetting tool including at least one nozzle configured to rotate within the tube and to emit a jet of pressurized fluid;

(b) supplying a pressurized fluid to the rotary jetting tool, such that the at least one nozzle emits a jet of pressurized fluid;

(c) advancing the rotary jetting tool until a gage ring on the rotary jetting tool contacts the foreign material to be removed, the gage ring being configured to prevent the at least one nozzle from directly contacting the foreign material to be removed;

(d) applying a constant force to advance the rotary jetting tool through the tube, so that the gage ring remains in contact with the foreign material to be removed, removal of portions of such foreign material enabling the rotary jetting tool to advance farther into the tube; and (e) balancing a pressure between an upper mechanical face seal and a lower mechanical face seal in the rotary jetting tool, wherein the upper mechanical face seal and the lower mechanical face seal are axially opposed.

66. The method of claim 65, farther comprising the step of reducing an amount of torque required to initiate rotation of the at least one nozzle by coupling an annular recess in the upper mechanical face seal with an ambient region that is external to rotary jetting tool, the annular recess separating the upper mechanical face seal into an inner mechanical face seal and an outer mechanical face seal.

67. The method of claim 65, further comprising the step of reducing an amount of torque required to initiate rotation of the at least one nozzle by coupling an annular recess in the lower mechanical face seal with the source of pressurized fluid, the annular recess separating the upper mechanical face seal into an inner mechanical face seal and an outer mechanical face seal.

68. The method of claim 65, wherein at least one of the upper mechanical face seal and the lower mechanical face seal is in fluid communication with the pressurized fluid, and further comprising the step of providing an orifice between the at least one of the upper mechanical face seal and the lower mechanical face seal and the source of the pressurized fluid, such that abrasive particles entrained within the pressurized fluid which are larger in size than the orifice are prevented from passing through the orifice and damaging the at least one of the upper mechanical face seal and the lower mechanical face seal.

69. A method for enabling abrasive particles to be included in a working fluid used in conjunction with a rotary jetting tool including a mechanical face seal, such that the abrasive particles do not damage the mechanical face seal, the method comprising the steps of:

(a) including an orifice in the rotary jetting tool, the orifice coupling the mechanical face seal in fluid communication with a fluid path configured to direct the working fluid through the rotary jetting tool;

(b) selecting abrasive particles having a size larger than the orifice;

(c) adding the abrasive particles to the working fluid; and (d) directing the working fluid including the abrasive particles into the fluid path in the rotary jetting tool, the orifice preventing the abrasive particles from passing through the orifice to reach the mechanical face seal and thereby damage the mechanical face seal.

* * * * *